US005457852A

United States Patent [19]

Liu

[11] Patent Number: 5,457,852

[45] Date of Patent: Oct. 17, 1995

[54] CLASP FOR MEDALLIONS OR THE LIKE

[75] Inventor: Jack W. Liu, New York, N.Y.

[73] Assignee: Ho Ho Art & Craft International Co., Inc., New York, N.Y.

[21] Appl. No.: 163,295

[22] Filed: Dec. 7, 1993

[51] Int. Cl.[6] ..... A44C 3/00

[52] U.S. Cl. ..... 24/13; 24/103; 40/1.5

[58] Field of Search ..... 24/13, 12, 11 M, 24/6, 710, 707, 304, 63, 103; 40/1.5; 63/20

[56] References Cited

U.S. PATENT DOCUMENTS

| | | | |
|---|---|---|---|
| 342,182 | 5/1886 | Chew | 24/710 |
| 882,178 | 3/1908 | Sloat | 24/13 |
| 2,071,021 | 2/1937 | Brandt | 24/13 |
| 2,145,296 | 1/1939 | Draper et al. | 24/103 |
| 2,153,157 | 4/1939 | Priesmeyer | 24/103 |
| 2,515,551 | 7/1950 | Cohen | 24/13 |
| 4,000,570 | 1/1977 | Carmen | 40/1.5 |
| 4,091,554 | 5/1978 | Bower | 63/20 |
| 4,290,215 | 9/1981 | Kise | 40/1.5 |
| 4,903,379 | 2/1990 | Uchtman | 40/1.5 |

*Primary Examiner*—Victor N. Sakran
*Attorney, Agent, or Firm*—Lalos & Keegan

[57] ABSTRACT

A clasp for a medallion or the like. The clasp includes a tubular member secured to and completely surrounded by the medallion and a safety pin movable between an upright position and a stowed position. The safety pin includes a secured leg and a movable leg, the secured leg being received through the tubular member. The movable leg is movable between an open position and a secured position. Both the safety pin and the tubular member are completely surrounded by the medallion. The safety pin lies flat against the medallion when in the stowed position.

1 Claim, 1 Drawing Sheet

CLASP FOR MEDALLIONS OR THE LIKE

BACKGROUND OF THE INVENTION

This invention relates to clasps for medallions or the like, and more particularly, to an improved clasp which lies relatively flat against the medallion.

Among the prior art clasps is a clasp rigidly mounted on the rear surface of a medallion. The clasp includes a flat portion secured to the medallion rear surface, a pivot structure protruding from one edge of the flat portion, and a catch secured to the opposite end of the flat portion. Mounted to the pivot structure is a movable leg which is received in the catch when the clasp is secured. Because this prior art clasp is rigidly mounted to the medallion, the clasp always protrudes significantly from the medallion.

Because it is often necessary to enclose medallions or the like in an envelope for sending through the mail, the protrusion of the prior art clasp from the medallion causes tears in the envelope. It is thus desirable to provide an improved clasp having a design which lies relatively flat against the medallion so as to be enclosed in an envelope without the risk of tearing or otherwise damaging the envelope.

Accordingly, it is an object of the present invention to provide an improved clasp for a medallion or the like.

Another object of the present invention is to provide an improved clasp for a medallion or the like which lies flat against the medallion.

A further object of the present invention is to provide an improved clasp for a medallion or the like in which the clasp is completely surrounded by the medallion.

A still further object of the present invention is to provide an improved clasp for a medallion or the like which can be enclosed in an envelope without damaging the envelope.

Other objects and advantages of the present invention will become more apparent to those persons having ordinary skill in the art to which the present invention pertains from the following description taken in conjunction with the accompanying drawings.

DESCRIPTION OF THE PREFERRED EMBODIMENTS

Figure 1:
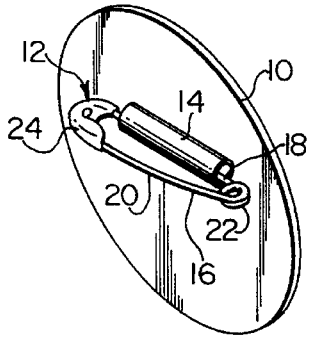
FIG. 1 is a perspective view of the preferred embodiment of the present invention, with the safety pin in the upright position.
Figure 2:
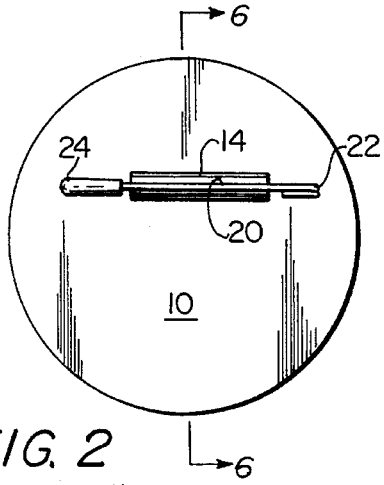
FIG. 2 is a top view of the embodiment of FIG. 1, with the safety pin in the upright position.
Figure 3:
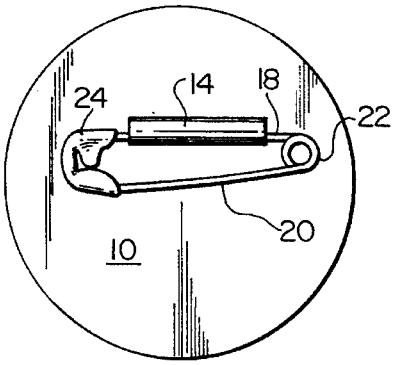
FIG. 3 is a top view with the safety pin in the flat, stowed position.
Figure 4:
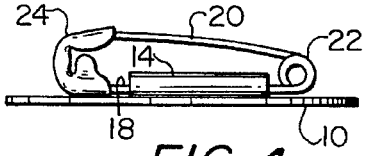
FIG. 4 is an end view with the safety pin in the upright position.
Figure 5:
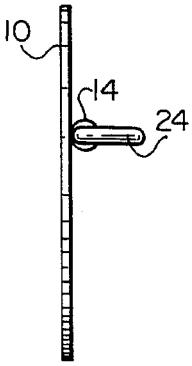
FIG. 5 is a side view with the safety pin in the upright position.

Referring to the illustration of the present invention shown in FIGS. 1–8, a medallion 10 is shown with a clasp 12. Clasp 12 generally includes tubular member 14 and safety pin 16. As seen in the figures, tubular member 14 and safety pin 16 are completely surrounded by the medallion, ensuring that neither the tubular member nor the safety pin is visible from the front of the medallion. Tubular member 14 is secured to medallion 10 by any conventional method, such as gluing, soldering or the like.

Safety pin 16 is a conventional safety pin and includes a secured leg 18, a movable leg 20, an intermediate coiled portion 22 linking the secured and movable legs, and a catch 24 to receive movable leg 20. Movable leg 20 includes a pointed end (not shown), thus enabling movable leg 20 to penetrate the surface to which the medallion is to be clasped. Movable leg 20 is biased by coiled portion 22 to move away from secured leg 18.

Secured leg 18 is received within tubular member 14. To facilitate manufacturing, tubular member is preferably made of a flat metallic plate. Secured leg 18 is placed against the flat plate, whereupon the plate is rolled to form the tubular member. Thus, tubular member includes a seam (not shown). For aesthetic reasons, it is preferred that the seam be placed against the medallion so that it is not visible once the tubular member is secured to the medallion.

Figure 6:
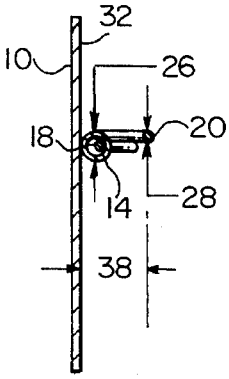
FIG. 6 is a sectional view taken along lines 6—6 of FIG. 2, with the safety pin in the upright position.
Figure 7:
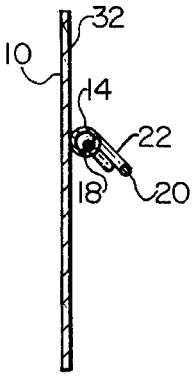
FIG. 7 is a sectional view similar to FIG. 6, with the safety pin in an intermediate position.
Figure 8:
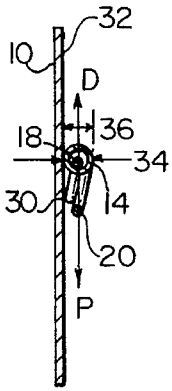
FIG. 8 is a sectional view similar to FIG. 6, with the safety pin in the flat, stowed position.

As best seen in FIGS. 6–8, the internal diameter 26 of tubular member 14 is significantly larger than the diameter 28 of secured leg 18. This permits the secured leg 18 to rotate freely, without interference, within tubular member 14. As previously stated, an important feature of the present invention is that the clasp lies flat against the medallion. FIGS. 6 through 8 show the safety pin in relation to the tubular member and the medallion in three positions: the upright position, an intermediate position, and the flat, stowed position, respectively. As seen in FIGS. 6 and 7, the secured leg 18 disposed within tubular member 14 has enough space to float within tubular member 14. Referring to FIG. 8, this space permits the safety pin to rotate as necessary until a portion of the coil, identified as 30, rests against medallion 10.

In the flat, stowed position of FIG. 8, it can be seen that if a plane is constructed containing both secured leg 18 and movable leg 20, the resulting plane, represented in FIG. 8 by P—P, is substantially parallel to a surface 32 of medallion 10. This ensures that the safety pin 16 lies flat against medallion 10. Additionally, as also seen in FIG. 8, when in the flat, stowed position, the height 34 of safety pin 16 is greatest at the point where intermediate coil portion 22 rests against medallion surface 32. Thus, height 34 is substantially equal to twice the diameter 28 of the legs. Again, this ensures that the safety pin does not protrude more than necessary, since the safety pin must necessarily be of a height which is at least twice the diameter 28 of the legs. Finally, the height 36 of tubular member 14 is significant in that it affects the extent to which clasp 12 protrudes from medallion 10. At a minimum, height 36 does not exceed the width 38 of the safety pin in its upright position, as shown in FIG. 6. It is preferable, however, that height 36 be substantially equal to or less than twice the diameter 28 of the legs. Thus, the limitations in height 34 of the safety pin and height 36 of the tubular member coupled with the provision that plane P—P lie substantially parallel to medallion surface 32 results in a clasp that lies flat against the medallion. It thus can be seen that the clasp as described herein can be enclosed in an envelope without damaging or tearing the envelope.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof, limited solely by the appended claims.

I claim:

1. A clasp for a medallion or the like, the clasp comprising:

a tubular member secured to and completely surrounded by the medallion, the tubular member contacting the medallion;

a safety pin movable between an upright position and a stowed position, the safety pin including a secured leg and a movable leg, the secured leg being received through the tubular member, the movable leg being movable between an open position and a secured position;

the tubular member being formed from a flat metallic plate rolled around the secured leg to form a seam and an internal diameter, the seam being placed against the medallion so as not to be visible;

wherein both the secured leg and the movable leg include a circular cross-section having a diameter, the tubular member internal diameter being significantly larger than the secured leg diameter to permit free rotation and floatation of the safety pin within the tubular member;

wherein the tubular member has a height substantially equal to twice the leg diameter;

wherein the safety pin includes a plane containing the secured leg and the movable leg, the plane being substantially parallel to a surface of the medallion when the safety pin is in the stowed position; and wherein the safety pin projects from the medallion when in the stowed position an amount substantially equal to twice the leg diameter.

* * * * *